US007936315B2

(12) United States Patent
Yu et al.

(10) Patent No.: US 7,936,315 B2
(45) Date of Patent: May 3, 2011

(54) ANTENNA SYSTEM AND METHOD FOR MAKING THE SAME

(75) Inventors: Chao-Hui Yu, Tu-Cheng (TW); Hung-Jen Chen, Tu-Cheng (TW); Yu-Yuan Wu, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 345 days.

(21) Appl. No.: 12/242,235

(22) Filed: Sep. 30, 2008

(65) Prior Publication Data

US 2010/0079352 A1 Apr. 1, 2010

(51) Int. Cl.
*H01Q 1/50* (2006.01)

(52) U.S. Cl. ..... 343/850; 343/852; 343/876

(58) Field of Classification Search ..... 343/850, 343/852, 876; 455/134, 142, 143, 550.1, 455/556.1, 557
See application file for complete search history.

(56) References Cited

U.S. PATENT DOCUMENTS

| | | | | |
|---|---|---|---|---|
| 3,243,708 | A * | 3/1966 | Manson | 455/144 |
| 5,634,203 | A * | 5/1997 | Ghaem | 455/134 |
| 6,208,847 | B1 * | 3/2001 | Kosuga | 455/142 |
| 7,340,274 | B2 * | 3/2008 | Harano | 455/556.1 |

* cited by examiner

*Primary Examiner* — Hoang V Nguyen
(74) *Attorney, Agent, or Firm* — Muncy, Geissler, Olds & Lowe, PLLC

(57) ABSTRACT

An antenna system adapted for a communication device has a common antenna with a predetermined length, an AM matching circuit matching with the common antenna and an FM matching circuit matching with the common antenna. A switch alternatively electrically connects the common antenna to the AM matching circuit and the FM matching circuit for achieving the AM function and FM function.

4 Claims, 7 Drawing Sheets

| | | | | |
|---|---|---|---|---|
| Mark1a | 0.52MHz | 279.70Ω | -1.1036kΩ | 277.34pF |
| Mark2a | 1.71MHz | 35.520Ω | 289.66Ω | 26.960μH |
| Mark3a | 1.334MHz | 28.213Ω | 691.63mΩ | 82.517nH |

| | | |
|---|---|---|
| Mark1a | 0.52MHz | 108.25 |
| Mark2a | 1.71MHz | 59.486 |
| Mark3a | 1.334MHz | 1.7801 |

| | | |
|---|---|---|
| Mark1a | 520KHz | 0.0945dB |
| Mark2a | 1.71MHz | 0.3580dB |
| Mark3a | 1.334MHz | 11.090dB |

| | | | | |
|---|---|---|---|---|
| Mark1b | 88MHz | 48.687Ω | 93.949Ω | 169.91nH |
| Mark2b | 98MHz | 52.532Ω | -33.236Ω | 48.863pH |
| Mark3b | 108MHz | 9.4608Ω | 14.657Ω | 21.599nH |

| | | |
|---|---|---|
| Mark1b | 88MHz | 5.4426 |
| Mark2b | 98MHz | 1.9055 |
| Mark3b | 108MHz | 5.6723 |

| | | |
|---|---|---|
| Mark1b | 88MHz | 3.2231dB |
| Mark2b | 98MHz | 10.205dB |
| Mark3b | 108MHz | 3.0294dB |

ANTENNA SYSTEM AND METHOD FOR MAKING THE SAME

BACKGROUND OF THE INVENTION

1. Field of the Invention

The present invention relates to the field of antennas, more particular to an antenna system which is capable of sharing a common antenna to achieve functions of amplitude modulation and frequency modulation.

2. The Related Art

With rapid development of mobile communications, the mobile phone, as a portable electrical device, has incorporated many functions for meeting user's requirements. For example, some mobile phones have the functions of amplitude modulation and frequency modulation for receiving broadcast program by an antenna system of the mobile phone. Conventionally, the antenna system of the mobile phone has two individual antennas. The individual antennas are adapted for matching with a frequency modulation (FM) matching circuit for achieving the FM function and an amplitude modulation (AM) matching circuit for achieving the AM function, respectively. That is, a user can operate the mobile phone to achieve both AM and FM functions through the separate antennas.

However, because mobile phones have been developed toward the miniaturization and the multifunction, such antenna system is not optimal. Adversely, the mobile phone needs to remain a biggish space for mounting the separate antennas, which will add the volume of the mobile phone or have an influence on the reasonable assembly of other electrical components of the mobile phone. In addition, it is particularly cumbersome to mount the separate antennas in the mobile phone. So it is required to design an antenna system used for a mobile phone which is capable of achieving the functions of AM and FM via a common antenna.

SUMMARY OF THE INVENTION

Accordingly, an object of the present invention is to provide an antenna system which is capable of sharing a common antenna to achieve the functions of amplitude modulation and frequency modulation. The antenna system has a common antenna with a predetermined length. An AM matching circuit matches with the common antenna and an FM matching circuit matches with the common antenna. A switch alternatively electrically connects the common antenna to the AM matching circuit and the FM matching circuit for achieving the AM function and FM function.

Another object of the present invention is to provide a method for manufacturing an antenna system. The method includes: providing a common antenna of a predetermined length; designing an AM matching circuit and an FM matching circuit matching with the common antenna respectively according to the length of the common antenna; and providing a switch for alternatively electrically connecting the common antenna to the AM matching circuit and the FM matching circuit.

As described above, since the antenna system has the switch to alternatively connect the only one common antenna with the AM matching circuit and the FM matching circuit for achieving the AM and FM function. In other words, the only one common antenna can be shared between the two matching circuits due to presence of the switch. Accordingly, such structure of the antenna system mounted in the mobile phone effectively reduces the occupied space as only one antenna is utilized by the phone, and therefore, it is possible to arrange other electrical components of the mobile phone reasonably thereinto. Meanwhile, the assembling process of the mobile phone is further simplified.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
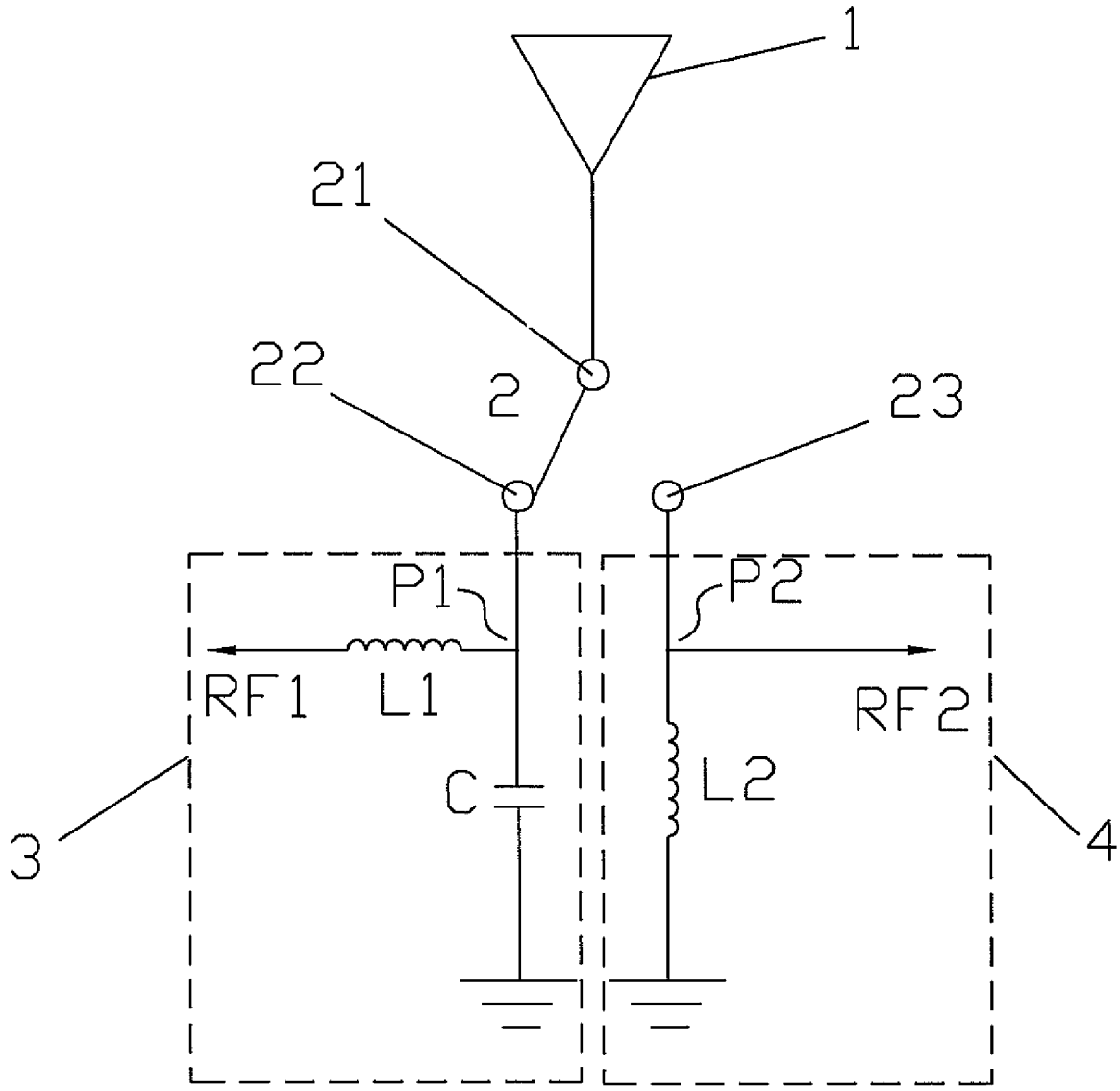
FIG. 1 is a schematic diagram showing an antenna system in an embodiment according to the present invention.

With reference to FIG. 1, an antenna system used in a mobile phone includes a common antenna 1, a switch 2, an AM matching circuit 3 and an FM matching circuit 4. In this embodiment, the length of the common antenna 1 is 1430 millimeter. The switch 2 defines a constant connection 21, a first selective connection 22 and a second selective connection 23. The constant connection 21 is connected with the common antenna 1.

The AM matching circuit 3 has a first RF circuit RF1. The first RF circuit RF1 is connected with the first selective connection 22 via a first inductor L1. In this embodiment, the inductance value of the first inductor L1 is 66 microhenry (uH). A connecting point P1 of the first inductor L1 adapted for connecting with the first selective connection 22 is grounded via a capacitor C. In this embodiment, the electrostatic capacitance of the capacitor C is 220 picofarad (pf).

The FM matching circuit 4 has a second RF circuit RF2. The second RF circuit RF2 is grounded via a second inductor L2. In this embodiment, the second inductor L2 is 82 nanohenry (nH). A connecting point P2 between the second RF circuit RF2 and the second inductor L2 is adapted for connecting with the second selective connection 23.

It should be noted that the length of the common antenna 1 of the antenna system is determined in accordance with the size of the mobile phone the antenna system mounted therein. The AM matching circuit 3 and the FM matching circuit 4 are designed according to the length of the common antenna 1.

A method for manufacturing the antenna system includes the steps of:

1. Providing the common antenna 1 having a predetermined length.

2. Designing the AM matching circuit 3 and the FM matching circuit 4 both matching with the common antenna 1 according to the length of the common antenna 1.

3. Assembling the switch 2 among the common antenna 1, the AM matching circuit 3 and the FM matching circuit 4 for alternatively electrically connecting the common antenna 1 to the AM matching circuit 3 and the FM matching circuit 4. It should also be noted that the process of manufacturing the antenna system 1 also can be changed for conforming to different demands and should not be limited.

When the antenna system 1 is operated at wireless communication for achieving the AM function, the switch 2 is adjusted to connect the common antenna 1 and the AM matching circuit 3, thus a signal received by the common antenna 1 passes through the switch 2 to flow into the AM matching circuit 3 so as to achieve the AM function. While the switch 2 is adjusted to connect the common antenna 1 and the FM matching circuit 4, a signal received by the common antenna 1 will pass through the switch 2 to flow into the FM matching circuit 4 so as to achieve the FM function.

Figure 2:
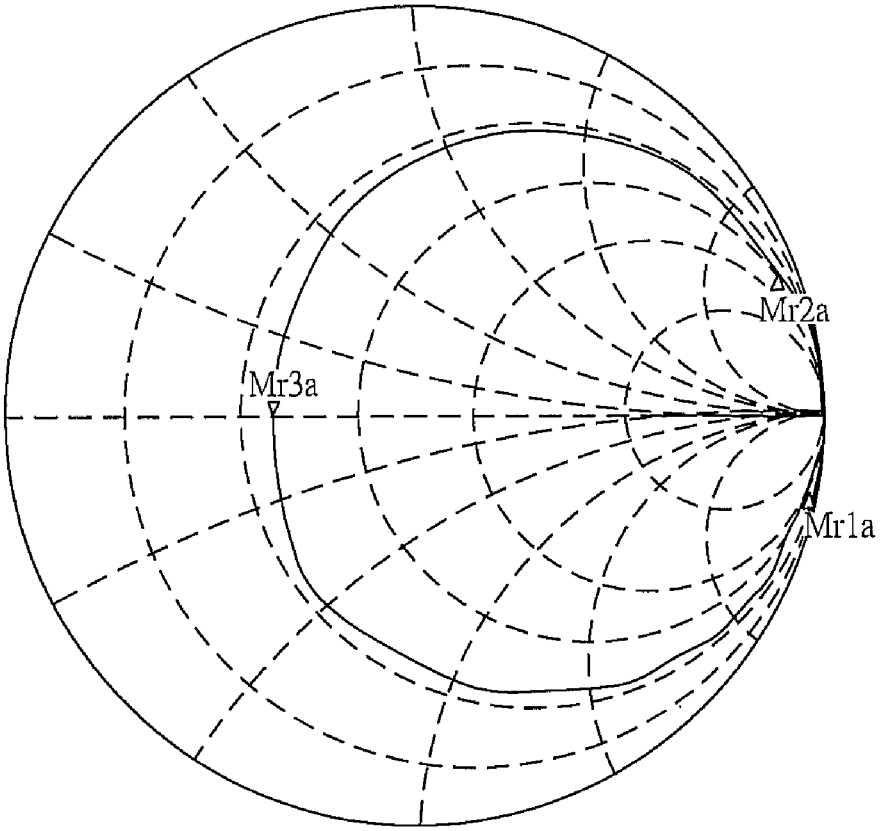
FIG. 2 is a Smith chart recording impedance of the antenna system shown in FIG. 1 when a switch is adapted to connect a common antenna with an AM matching circuit.

Please refer to FIG. 2, which shows a Smith chart recording impedance of the antenna system in this embodiment when the antenna system operates at wireless communication for achieving the AM function. The antenna system exhibits an impedance of (279.7−j1103.6) Ohm at 0.52 MHz (indicator Mr1*a* in FIG. 2), an impedance of (35.52+j289.66) Ohm at 1.71 MHz (indicator Mr2*a* in FIG. 2), and an impedance of (28.213+j0.69163) Ohm at 1.334 MHz (indicator Mr3*a* in FIG. 2).

Figure 3:
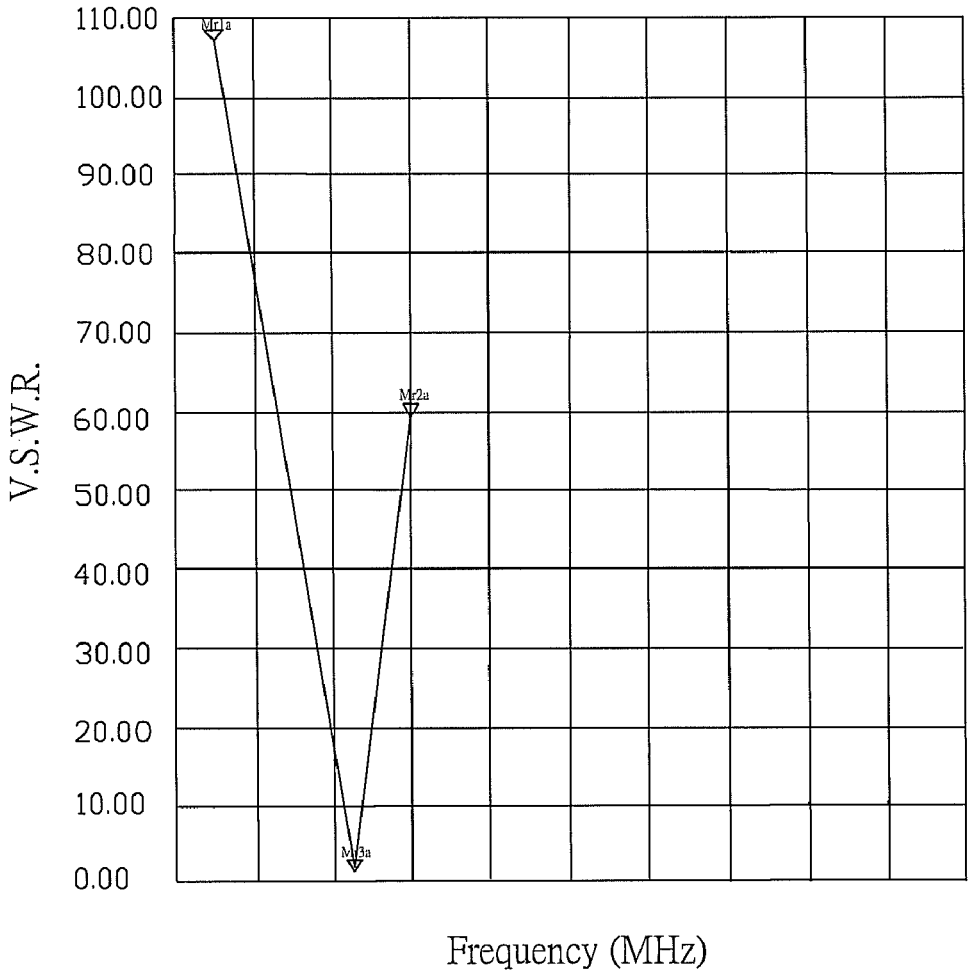
FIG. 3 shows a Voltage Standing Wave Ratio (VSWR) test chart of the antenna system shown in FIG. 1 when the switch is adapted to connect the common antenna with the AM matching circuit.

Please refer to FIG. 3, which shows a Voltage Standing Wave Ratio (VSWR) test chart of the antenna system in this embodiment when the antenna system operates at wireless communication for achieving the AM function. When the antenna system operates at 0.52 MHz (indicator Mr1*a* in FIG. 3), the VSWR value is 108.25. When the antenna system operates at 1.71 MHz (indicator Mr2*a* in FIG. 3), the VSWR value is 59.486. When the antenna system operates at 1.334 MHz (indicator Mr3*a* in FIG. 3), the VSWR value is 1.7801.

Figure 4:
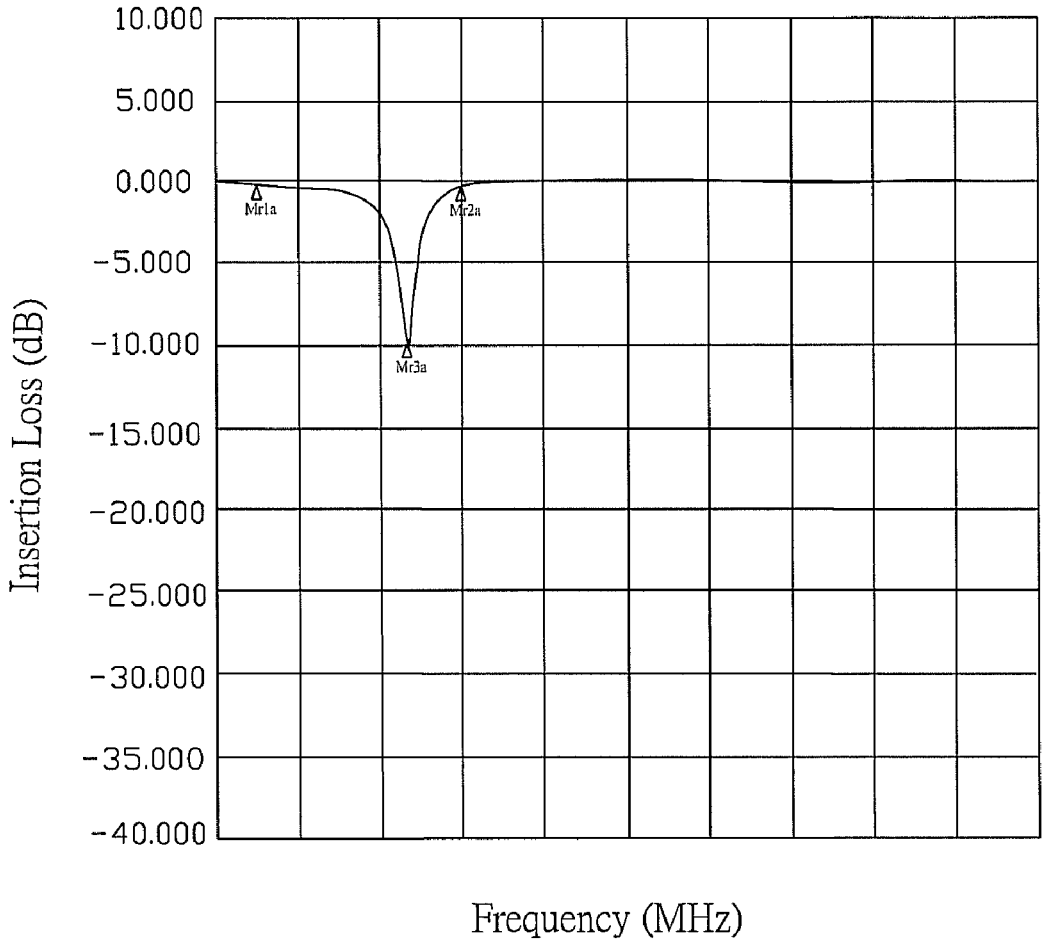
FIG. 4 is a graph showing the relation between insertion loss and frequency in the antenna system shown in FIG. 1 when the switch is adapted to connect the common antenna with the AM matching circuit.

Please refer to FIG. 4, which shows a graph illustrating the relation between insertion loss and frequency in the antenna system in this embodiment when the antenna system operates at wireless communication for achieving the AM function. When the antenna system operates at 520 KHz (indicator Mr1*a* in FIG. 4), the insertion loss value is 0.0945 dB. When the antenna system operates at 1.71 MHz (indicator Mr2*a* in FIG. 4), the insertion loss value is 0.3580 dB. When the antenna system operates at 1.334 MHz (indicator Mr3*a* in FIG. 4), the insertion loss value is 11.09 dB.

Figure 5:
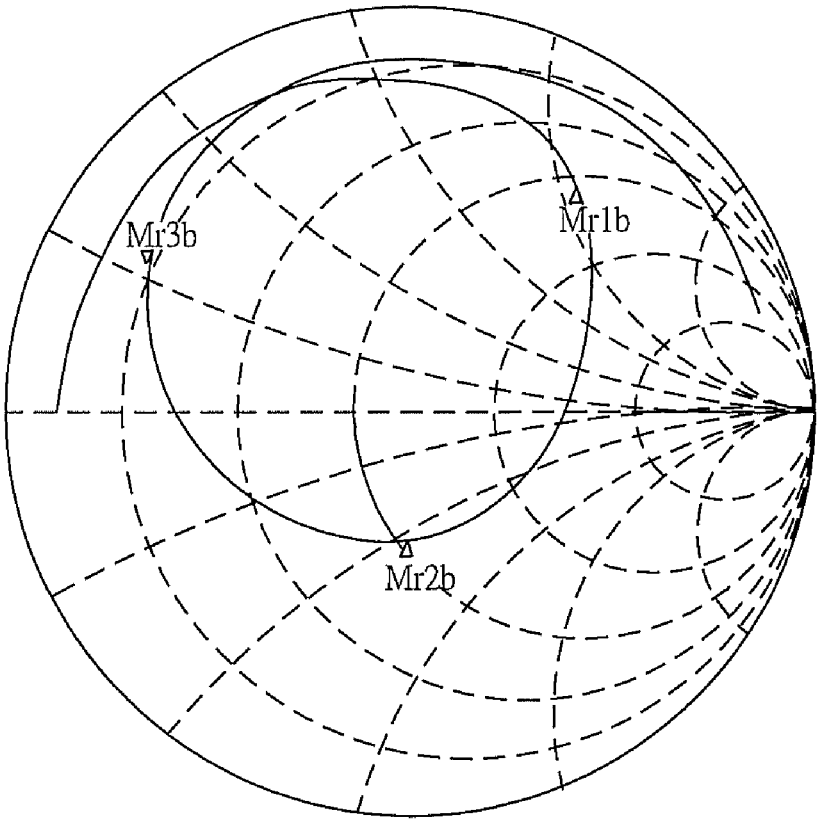
FIG. 5 is a Smith chart recording impedance of the antenna system shown in FIG. 1 when the switch is adapted to connect the common antenna and an FM matching circuit.

Please refer to FIG. 5, which shows a Smith chart recording impedance of the antenna system in this embodiment when the antenna system operates at wireless communication for achieving the FM function. The antenna system exhibits an impedance of (48.687+j93.949) Ohm at 88 MHz (indicator Mr1*b* in FIG. 5), an impedance of (52.532−j33.236) Ohm at 98 MHz (indicator Mr2*b* in FIG. 5), and an impedance of (9.4608+j14.657) Ohm at 108 MHz (indicator Mr3*b* in FIG. 5).

Figure 6:
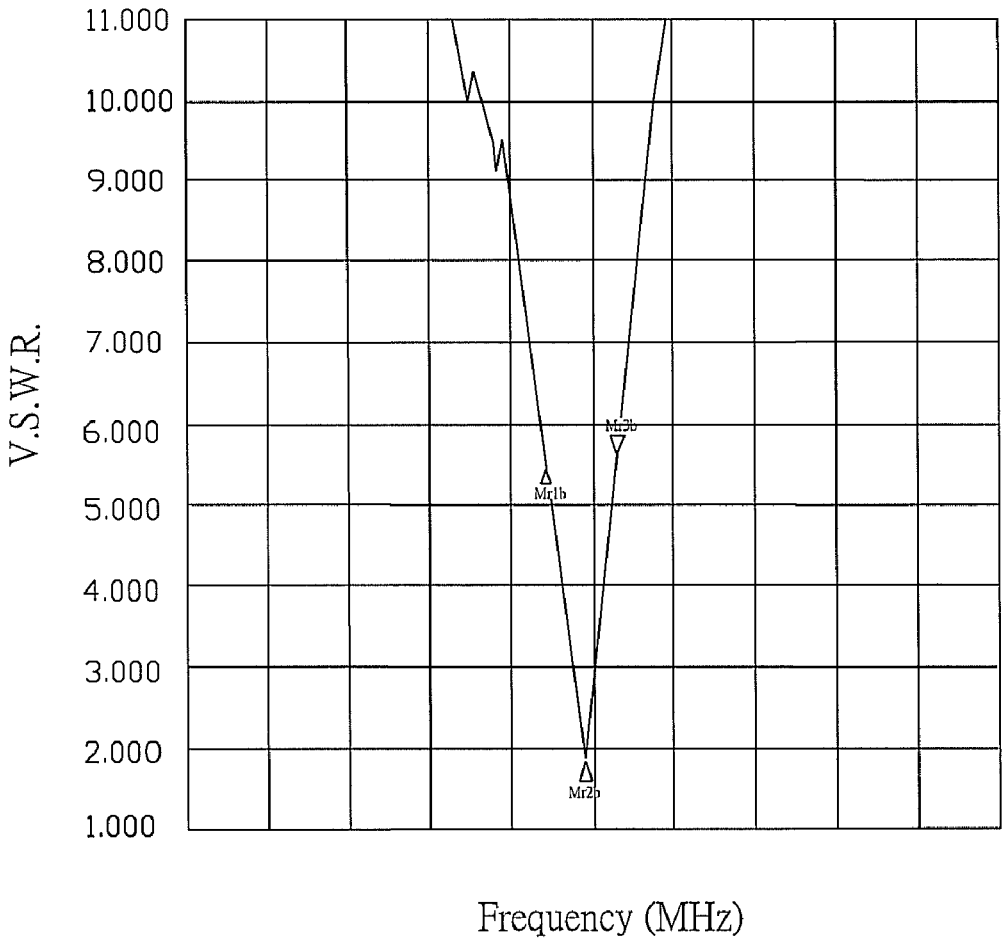
FIG. 6 shows a VSWR test chart of the antenna system shown in FIG. 1 when the switch is adapted to connect the common antenna and the FM matching circuit.

Please refer to FIG. 6, which shows a VSWR test chart of the antenna system in this embodiment when the antenna system operates at wireless communication for achieving the FM function. When the antenna system operates at 88 MHz (indicator Mr1*b* in FIG. 6), the VSWR value is 5.4426. When the antenna system operates at 98 MHz (indicator Mr2*b* in FIG. 6), the VSWR value is 1.9055. When the antenna system operates at 108 MHz (indicator Mr3*b* in FIG. 6), the VSWR value is 5.6723.

Figure 7:
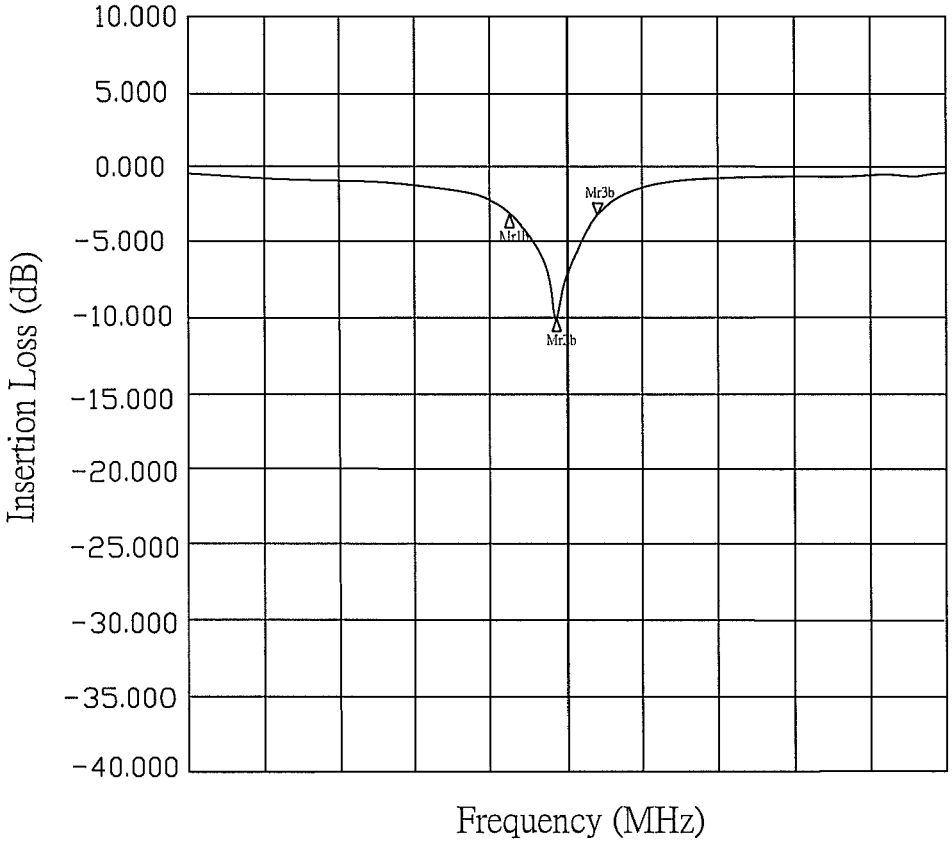
FIG. 7 is a graph showing the relation between insertion loss and frequency in the antenna system shown in FIG. 1 when the switch is adapted to connect the common antenna with the FM matching circuit.

Please refer to FIG. 7, which shows a graph illustrating the relation between insertion loss and frequency in the antenna system in this embodiment when the antenna system operates at wireless communication for achieving the FM function. When the antenna system operates at 88 MHz (indicator Mr1*b* in FIG. 7), the insertion loss value is 3.2231 dB. When the antenna system operates at 98 MHz (indicator Mr2*b* in FIG. 7), the insertion loss value is 10.205 dB. When the antenna system operates at 108 MHz (indicator Mr3*b* in FIG. 7), the insertion loss value is 3.0294 dB.

As described above, the antenna system has the switch 2 to alternatively connect the common antenna 1 with the AM matching circuit 3 and the FM matching circuit 4 for achieving the AM and FM function respectively. Such structure of the antenna system mounted in the mobile phone reduces the internal space occupied by other components for example those described herein, thus facilitating installation of other electrical components of the mobile phone into the mobile phone reasonably, and at the same time, the assembling process of the mobile phone is also simplified.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An antenna system adapted for a communication device, comprising:

a common antenna with a predetermined length;

an AM matching circuit matching with the common antenna;

an FM matching circuit matching with the common antenna; and a switch alternatively electrically connecting the common antenna to the AM matching circuit and the FM matching circuit;

wherein the AM matching circuit has a first RF circuit, and a first inductor adapted to connect the first RF circuit and the switch, a connection point of the first inductor capable of connecting with the switch being grounded via a capacitor.

2. The antenna system as claimed in claim 1, wherein the value of the first inductor is 66 microhenry, and the electrostatic capacitance of the capacitor is 220 picofarad.

3. An antenna system adapted for a communication device, comprising:

a common antenna with a predetermined length;

an AM matching circuit matching with the common antenna;

an FM matching circuit matching with the common antenna; and a switch alternatively electrically connecting the common antenna to the AM matching circuit and the FM matching circuit;

wherein the FM matching circuit has a second RF circuit, the second RF circuit is grounded via a second inductor, a connection point between the second RF circuit and the second inductor being adapted for connecting with the switch.

4. The antenna system as claimed in claim 3, wherein the value of the second inductor is 82 nanohenry.

* * * * *